United States Patent [19]

Pole et al.

[11] Patent Number: 5,049,021

[45] Date of Patent: Sep. 17, 1991

[54] SELF-UNLOADING METHOD AND APPARATUS FOR SHIPS

[75] Inventors: Charles D. Pole, Willowdale; Daniel B. Baker, Etobicoke, both of Canada

[73] Assignee: ULS Corporation, Toronto, Canada

[21] Appl. No.: 343,613

[22] Filed: Apr. 27, 1989

[30] Foreign Application Priority Data

Apr. 27, 1988 [CA] Canada ..... 565,293

[51] Int. Cl.[5] ..... B63B 27/22

[52] U.S. Cl. ..... 414/141.9; 198/511; 414/141.1; 414/142.5; 414/143.1

[58] Field of Search ..... 414/141.1, 141.9, 142.1, 414/142.2, 142.5, 143.1; 198/509, 511, 519

[56] References Cited

U.S. PATENT DOCUMENTS 3,144,142 8/1964 Wallace, Jr. ..... 414/142.5
3,847,290 11/1974 Suykens ..... 414/142.5
4,738,578 4/1988 Johnston ..... 414/142.5

FOREIGN PATENT DOCUMENTS 55-39822 3/1980 Japan ..... 414/142.5

*Primary Examiner*—David A. Bucci
*Assistant Examiner*—Janice Krizek
*Attorney, Agent, or Firm*—Foley & Lardner

[57] ABSTRACT

An unloading marine leg for a self-unloading ship including a bucket conveyor for removing granular material from the hold of a ship, the marine leg including a distal end and a discharge end with the discharge end being pivotally mounted to a carriage on a travelling bridge on the deck of the ship. The travelling bridge includes tracks extending athwartship on which the carriage is mounted for athwartship movement and the marine leg can pivot between a vertical position with the distal end near the bottom of the hold and a rest position with the marine leg parallel with the travelling bridge.

2 Claims, 3 Drawing Sheets

SELF-UNLOADING METHOD AND APPARATUS FOR SHIPS

BACKGROUND OF THE INVENTION

1. Field of the Invention

This invention relates to an apparatus for unloading particulate material from ships.

More specifically, the invention relates to a simple economical method of converting a standard Great Lakes bulk carrying ship into a vessel capable of discharging grain or other free flowing cargoes to a shore-based hopper or pile.

2. Description of the Prior Art

The bulk of grain is unloaded world-wide from vessels by shore-based equipment in the form of bucket elevator legs, vacuum hoses, screw elevators, en masse elevators and other devices. This shore-based equipment is generally costly to install, maintain and also operate. Shore-based grain elevators with significant flowthrough tonnages can justify the expenditure and operating costs of the required unloading equipment, but grain elevators with smaller requirements tend to attract vessels capable of discharging the grain with ship board equipment.

There are numerous ships trading both on the ocean and within the Great Lakes system which can self-charge by one method or another and there is a trend to have more of these vessels deliver grain to ports having smaller grain elevators without proper unloading facilities.

These self-unloading vessels are generally designed to carry a wide variety of different cargoes and tend to be more sophisticated than is required for many of the grain trades.

Self-unloaders fall into several categories, including gravity type which has hopper shaped holds with bottom feeding to two or more fore and aft conveyor belts which in turn feed an elevating device which feeds a long conveyor boom for shore delivery. Another is the reclaimer type which has a large material reclaiming device in the hold which feeds a fore and aft conveyor belt situated below the tank top or bottom of the hold. This conveyor belt feeds the elevating device in a similar fashion to the gravity-type described above.

Various other systems have been developed over the years which discharge the cargo through the hatch openings on deck. These have taken the form of bucket elevators, screw conveyors, grab buckets and the like. These devices have tended to be heavy, expensive and elaborate. In cases where an elevating leg enters the hold to retrieve particulate cargo, the leg moves along a vertical axis requiring a substantial supporting structure to retain stability when the vertical leg is extended above deck. The majority of the shipboard unloading systems which have been developed to date, while suitable for unloading grain or other free flowing cargoes suffer from their physical size, weight and high cost.

The present design of a Great Lakes vessel has evolved over the years to suit the particular trading patterns and the restrictions of these waters including navigation in the St. Lawrence Seaway system. The vessels have a length of between 700 ft. and 1000 ft. and a beam of between 70 ft. and 105 ft. The depth of the vessels vary between 40 ft. and 50 ft. and all have decks clear of obstruction to facilitate easy loading and unloading.

A typical Seaway size lake vessel will have a length of 730 ft., a beam of 75 ft., and a depth of 40 ft. The cargo space length will be about 550 ft. which is usually divided fore and aft by bulkheads into, approximately five holds each of about 110 ft. in length. There are generally a number of single piece hatch covers on the deck above each hold to allow for loading and unloading. These covers measure about 50 ft. athwartships and about 15 ft. in the fore and aft direction. The single-piece hatch covers are clamped to the raised hatch coamings around the hatch openings when the vessel is at sea and are removed in port by a hatch crane prior to loading or unloading. The hatch crane is a steel bridge which straddles the hatch covers in an athwartships direction and is mounted on rail tracks which run in a fore and aft direction for the entire length of the open deck. The rails are positioned outboard of the hatch coamings and between these coamings and the ship's side. Power driven winches are located on the heavy athwartships beams of the hatch crane and these are used to lift the covers on or off as required. The hatch crane bridge is powered to travel in the fore and aft direction on the rails which is necessary in order to place the covers in a storage location.

The present invention is particularly applicable to vessels designed for and trading within the North American Great Lakes system including the St Lawrence Seaway. It primarily addresses modifications which can be affected to existing vessels, but the system could also be built into new vessels.

It is an aim of this invention to introduce an unloading system which takes advantage of certain characteristics of "Lake" style vessels and also uses equipment already installed on board.

The invention takes advantage of the long unobstructed deck of a "Lake" vessel, and the hatch crane bridge described above or, another similar type bridge equipped for the intended purpose. It also utilizes the rail tracks which carry the deck crane.

The system is tailored to the receiving capabilities of the smaller grain elevators and is light in weight. The installation of the unloading system would not detract from the capabilities of the vessel when trading as a standard bulk carrier and, as no cargo hold hoppers are required, it would not reduce the cargo hold volume which would affect the earning capacity of the vessel.

A construction in accordance with the present invention for unloading particulate material from the elongated hold of a ship having a deck provided with a number of athwartship elongated hatches leading to the hold spaced apart in the fore and aft direction, comprises a mounting means above the deck for movement in the athwartships direction and in the fore and aft direction. An unloading leg in the form of a continuous conveyor means having a discharge end and a distal end is provided which can pivot on the mounting means. The discharge end of the conveyor means is pivotally mounted to the mounting means for pivotal movement of the leg about a horizontal pivot axis in an athwartship plane from a rest position above the deck to a vertical position with the distal end near the bottom of the hold. Means are provided for raising and lowering the distal end of the conveyor means into the hold by pivoting the unloading leg about the pivot axis of the conveyor means. Means are provided for receiving material from the discharge end of the conveyor means and conveying it outboard of the ship.

A specific embodiment of the present invention includes an unloading system which comprises a marine grain leg pivoted by a pivot shaft to a carriage mounted through drive wheels on rail tracks on an unloading bridge. A winch mounted on the bridge is used to raise or lower the working end of the leg with a luffing cable to reach the grain in the cargo hold. A transfer conveyor belt adjacent to the marine leg runs in an athwartship direction on the bridge. A transfer chute to direct the grain to a fore and aft conveyor belt which is installed parallel to the deck rails and over the entire length of the open deck. At the forward or after end of the vessel, a system of transfer and elevating equipment i used to feed the grain to an unloading boom to carry the grain to the elevator.

BRIEF DESCRIPTION OF THE DRAWINGS

The invention will be described, in more detail, by reference to the accompanying drawings, illustrating a preferred embodiment, and in which.

DESCRIPTION OF THE PREFERRED EMBODIMENTS

Figure 2:
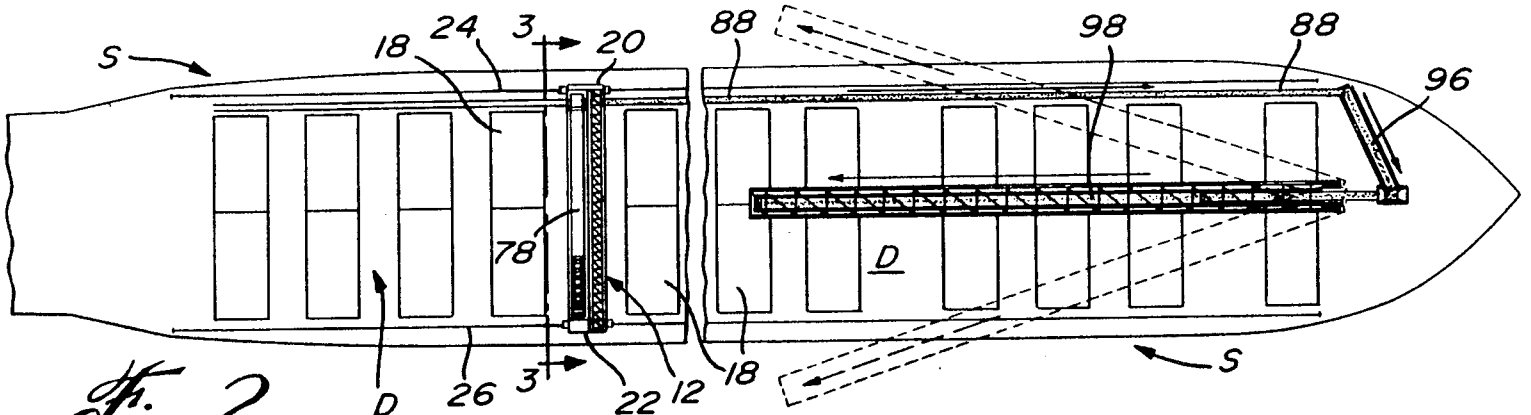
FIG. 2 is a plan view of the ship of FIG. 1.
Figure 1:
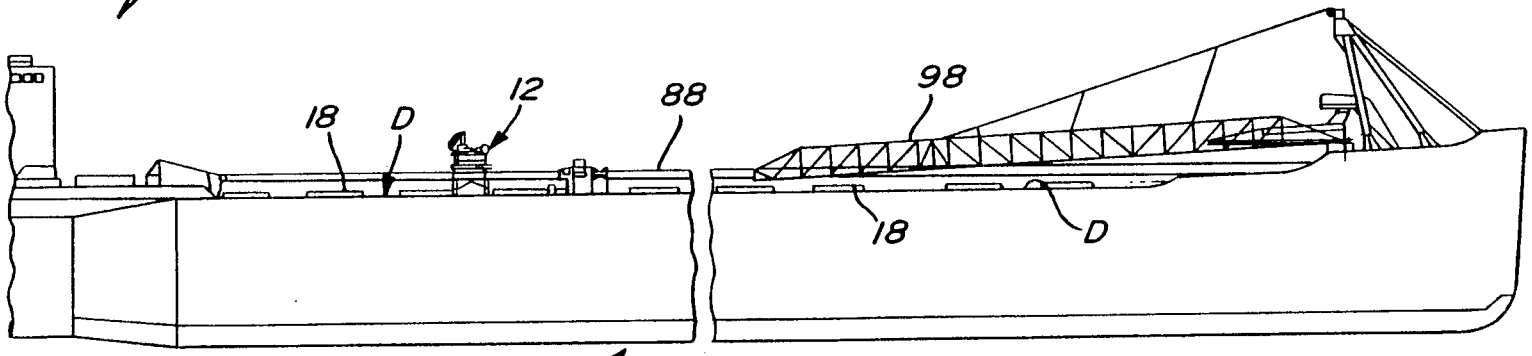
FIG. 1 is a side elevation of a ship equipped with an unloading mechanism, according to the invention.

Referring now to the drawings and in particular to FIGS. 1 and 2 there is shown a conventional Lake vessel S having a deck D with a series of hatch covers 18 covering the holds H. The hatch covers 18 are spaced in fore and aft alignment. Rails 24 and 26 extend on either side of the series of hatch covers 18 and a bridge 12 mounted on uprights 20 rides on the rails 24 and 26. The bridge 12 would normally have a hatch crane provided thereon for lifting the hatches 18 and moving the hatches 18 for storage in order to have access to the holds below the hatch openings. All the above elements would be provided on a conventional ship.

Figure 3:
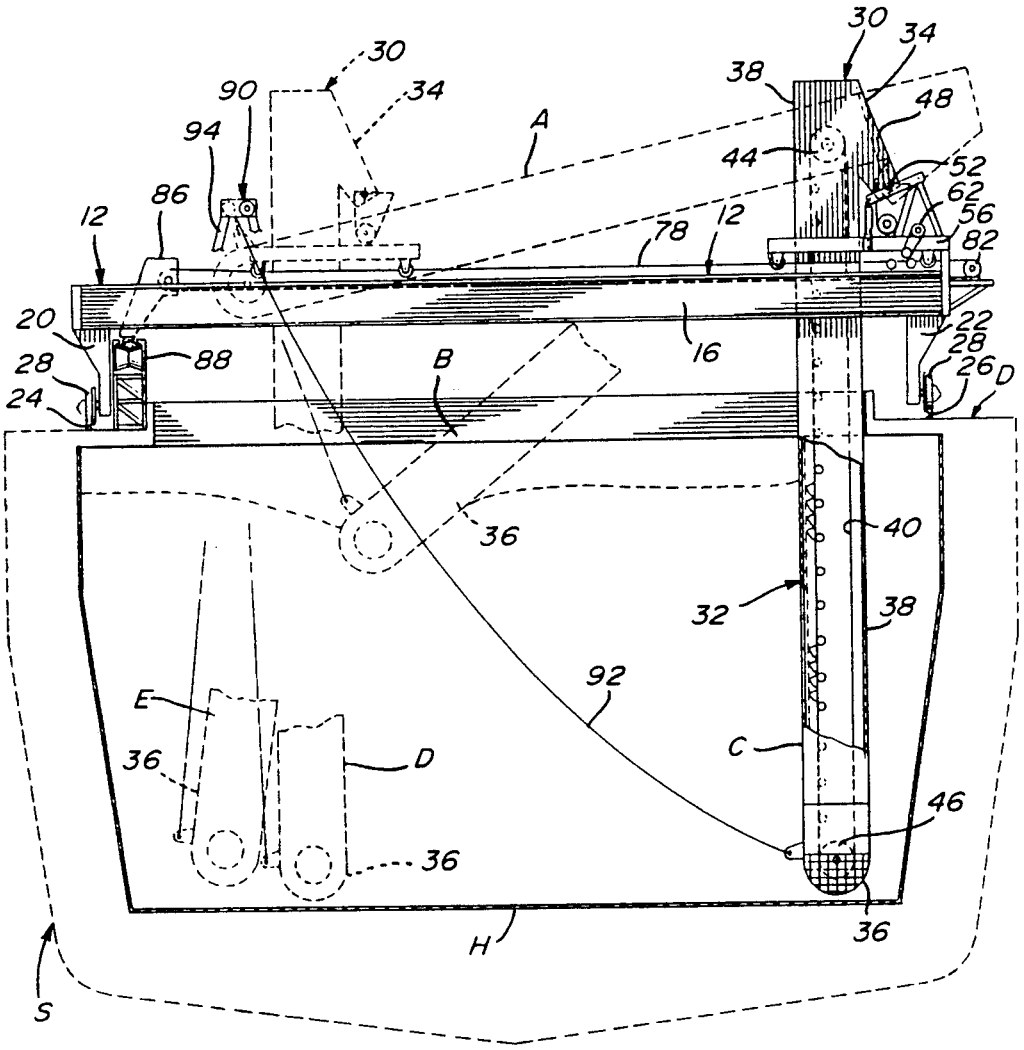
FIG. 3 is a vertical cross-section taken along line 3—3 of FIG. 2 showing the unloading mechanism in different operating positions.

According to the present invention a marine leg loading apparatus 30 is mounted on the bridge 12 for removing granular material from the hold H as shown in FIG. 3. Although the marine leg 30 may be mounted on the bridge 12 to which the hatch crane is set up it could also be on a separate bridge operating on the rails 24 and 26, independently of the bridge mounting the hatch crane.

Figure 4:
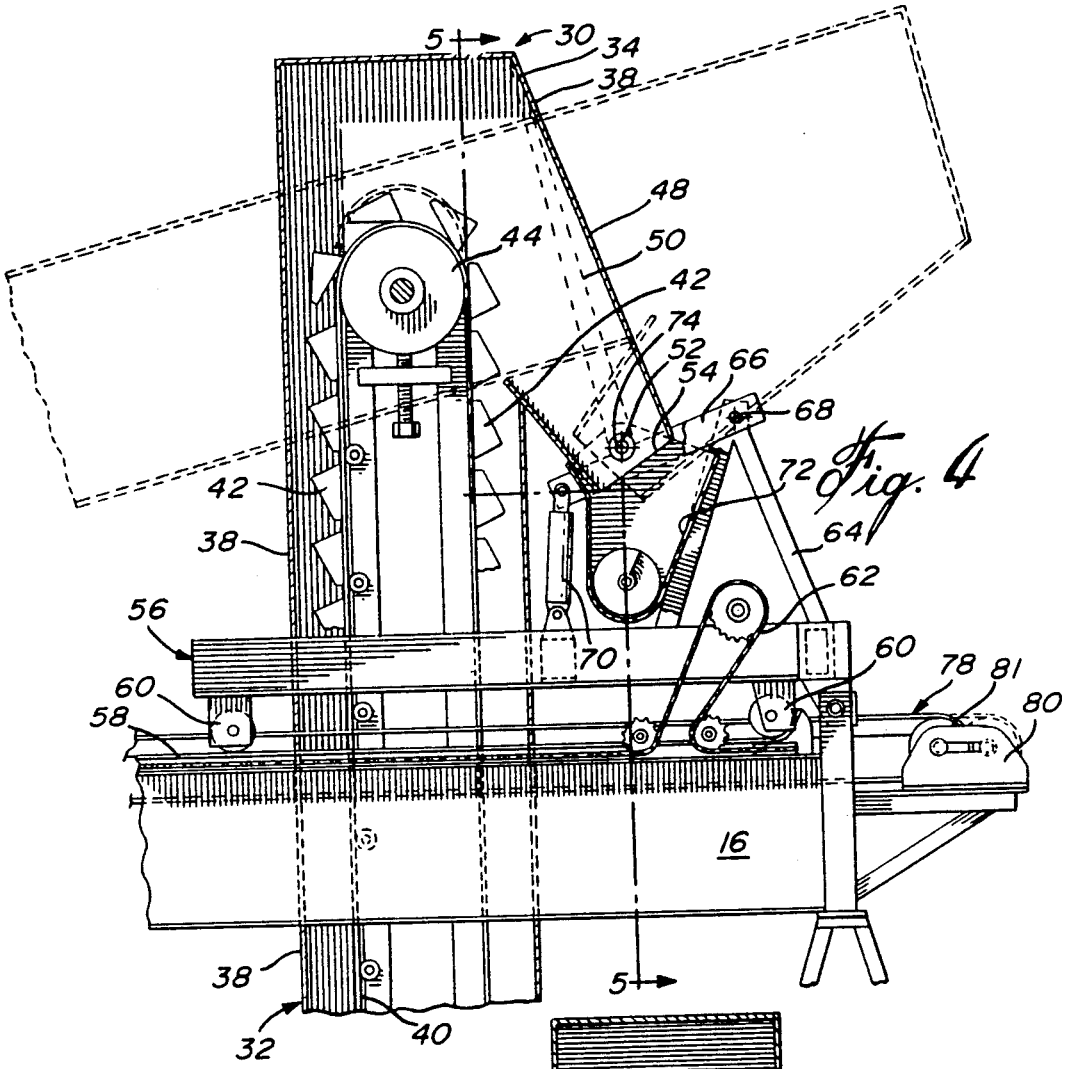
FIG. 4 is an enlarged fragmentary vertical cross-section of a detail shown in FIG. 3.
Figure 5:
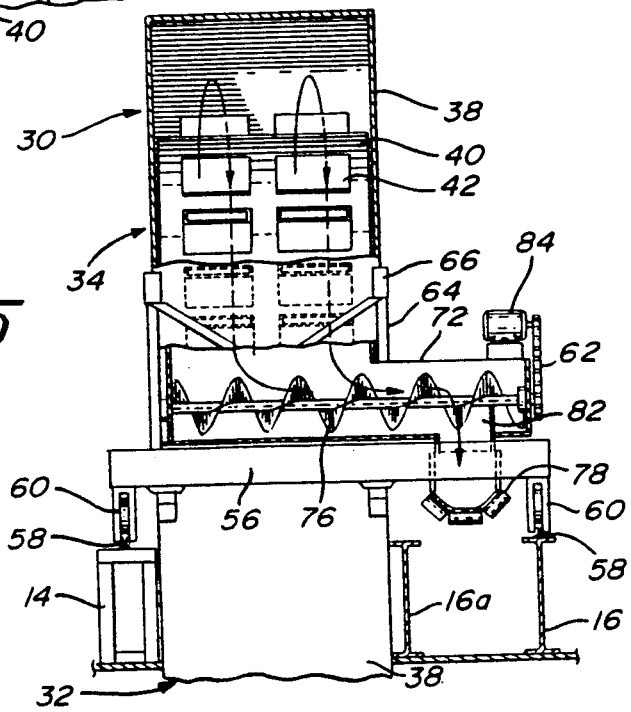
FIG. 5 is an enlarged fragmentary vertical cross-section taken generally along lines 5—5 of FIG. 4.

As shown in FIGS. 3 to 5 the bridge 12 includes girders 14, 16 and 16*a* extending athwartship and being supported by uprights 20 and 22 which in turn mount wheels 28 riding on rails 24 and 26 respectively. The unloading apparatus or marine leg 30 includes an endless bucket conveyor 32 having a discharge end 34 and a distal or pick-up end 36. The bucket conveyor 32 includes a conveyor housing 38 which completely encloses the bucket conveyor 32.

The bucket conveyor 32 includes a conveyor belt 40 running over pulleys 44 and 46 and mounting conventional scooped buckets 42. At the discharge end 34 of the marine leg 30 there is provided a tapered chute 48. The discharge end 34 of the marine leg 30 and the chute 48 include reinforcing frame members 50 shown in dotted lines in FIG. 4 which in turn mount journals 52 at the discharge opening 54. The journals 52 will be referred to later.

The marine leg 30 is mounted on a carriage 56 which is adapted to travel athwartship on the bridge 12. The bridge 12 mounts rails 58 while the carriage 56 includes wheels 60 which are adapted to travel on the rails 58.

Referring to FIG. 4 there is provided a support frame 64 on the carriage 56 and a pivoting frame 66 is pivotally mounted about the shaft 68 to the support frame 64. The other end of the pivoting frame 66 is mounted to a hydraulic piston and cylinder arrangement 70 which can adjust the height or angle of the pivoting frame 66. The pivoting frame 66 mounts a shaft 74 on which the journals 52 are provided.

Thus, the marine leg 30 is pivoted about the axis of the shaft 74 by means of this structure. The actual axis of the shaft 74 can be adjusted by means of the piston and cylinder arrangement 70.

The carriage 56 is moved athwartwise along the bridge 12 by means of a chain drive 62 driven by a motor 84. The carriage 56 also mounts a trough 72 which is immediately below the discharge opening 54 of the chute 48 on the discharge end 34 of the bucket conveyor 32. The pivot axis of the discharge end 34 is coincident with the discharge opening 54 so that the discharge opening 54 is always coincident with the trough 72, no matter what the relative position of the marine leg 30 is.

A screw conveyor 76 is mounted within the trough 72 as shown in FIG. 5 for moving the granular material being discharged in the trough 72 towards an opening 82. The opening 82 is located over a conveyor 78 extending the length of the bridge 12 and mounted at the distal end by means of a bracket 80 mounting a pulley 81. The discharge of the conveyor 78 ends at a discharge chute 86 on the port side of the ship S immediately above the conveyor 88 which extends fore and aft of the ship.

A winch 90 is mounted on a winch support 94 and the winch draws a cable 92 attached to the distal end 36 of the bucket conveyor 32.

Referring now to FIG. 2, the fore and aft conveyor 88 is shown extending to the bow section of the ship S and discharges on a transfer conveyor 96 which in turn conveys the granular material being discharged to the heel of a boom conveyor 98.

Thus, in operation, the bucket conveyor 32 can be pivoted on its journal 52 about the shaft 74 mounted on the carriage 56 to any position in a roughly 80° angle from the vertical, shown in FIG. 3, to a storage position where it is almost parallel with the bridge 12.

Thus, when it is necessary to unload grain or other granular material from the hold H in a ship the marine leg 30 will be pivoted from the position shown in dotted lines above the bridge 12 at A, to a position shown in dotted lines at B just above the level of the grain in the hold H. As the marine leg 30 is pivoted downwardly by gravity as the hold H empties, it eventually reaches a vertical position at C, as shown in full lines in FIG. 3. From that position, the distal end 36 can be lifted by the winch 90 which draws the cable 92.

While the marine leg 30 is in a vertical position, the carriage 56 on which the marine leg 30 is mounted can be moved athwartship on the bridge 12 to enter into areas of the hold in which the grain might still be present. Thus, the marine leg 30 can be guided to almost any position in the hold H as shown by positions C, D , and E. When it is required to move the bridge 12 to another hold or for storing the bridge the cable 92 is drawn by the winch 90 to move the marine leg 30 back to its storage position A.

The material is conveyed by the bucket conveyor 32 through the discharge chute 48 onto the trough 72. The screw conveyor 76 moves the granular material onto the conveyor 78 towards the port side of the ship 12 onto the conveyor 88. The material then advances on the conveyor 88 to the transfer conveyor 96, and then is transferred to the boom conveyor 98 to an unloading area on the dock outboard of the ship S.

We claim:

1. An apparatus for unloading particulate material from an elongated hold of a ship having a deck provided with a number of athwartship elongated hatches leading to the hold spaced apart in the fore and aft direction, the apparatus comprising mounting means above the deck for movement in the athwartship direction and in the fore and aft direction, an unloading leg in the form of an elongated housing mounting a continuous conveyor means having a discharge end and a distal end, the discharge end including a discharge chute communicating with the elongated housing, and frame means incorporated in the housing and the chute and supporting the conveyor means, the discharge chute defining a discharge opening, the frame means being pivotally mounted about a horizontal pivot axis on said mounting means such that the unloading leg can pivot in a vertical athwartship plane from a rest position above the deck to a vertical position with the distal end near the bottom of the hold, means for raising and lowering the distal end of the unloading leg into the hold by pivoting the unloading leg about said horizontal pivot axis, said horizontal pivot axis being coincident with the discharge opening in the chute such that when the frame means is pivoted about the horizontal pivot axis, the discharge opening will remain concentric to the horizontal pivot axis and a trough immediately under the discharge opening, and wherein the mounting means includes a bridge extending athwartship across the deck of the ship, track means above the deck for supporting the bridge for fore and aft movement along the deck above the hatches, carriage means on the bridge, track means extending athwartship of the bridge for supporting the carriage means for athwartship movement, an athwartship conveyor means standing along the bridge for receiving the material from the discharge opening of the chute, and wherein the trough means includes a screw conveyor for moving the material being discharged into the trough onto the athwartship conveyor and means are provided at the discharge end of the athwartship conveyor for conveying the material being discharged therefrom.

2. An apparatus as defined in claim 1, wherein a shaft is mounted on said carriage means coincident with the horizontal pivot axis, journal means are provided on the frame means of the discharge housing associated with the shaft such that the unloading leg can pivot about the horizontal pivot axis, said journal means on said discharge housing frame being coincident with the discharge opening such that when the unloading leg is pivoted about the shaft, the discharge opening remains concentric to the horizontal axis.

* * * * *